United States Patent [19]

OtA et al.

[11] Patent Number: 4,886,730

[45] Date of Patent: Dec. 12, 1989

[54] LIQUID DEVELOPER FOR ELECTROSTATIC PHOTOGRAPHY

[75] Inventors: Ikuo OtA, Tsukui; Hayato Hyakutake, Hino; Ryo Kobirumaki, Hachioji, all of Japan

[73] Assignee: Iwatsu Electric Co., Ltd., Tokyo, Japan

[21] Appl. No.: 217,767

[22] Filed: Jul. 11, 1988

[30] Foreign Application Priority Data

Jul. 29, 1987 [JP] Japan ..... 62-187786
Oct. 28, 1987 [JP] Japan ..... 62-270248

[51] Int. Cl.[4] ..... G03G 9/16; G03G 15/10

[52] U.S. Cl. ..... 430/137; 430/112; 430/115; 430/117

[58] Field of Search ..... 430/112, 115, 117, 137

[56] References Cited

U.S. PATENT DOCUMENTS 4,547,449 10/1985 Alexandrovich et al. ..... 430/112 X
4,659,640 4/1987 Santilli ..... 430/119

*Primary Examiner*—Paul R. Michl
*Assistant Examiner*—Jeffrey A. Lindeman
*Attorney, Agent, or Firm*—Paul & Paul

[57] ABSTRACT

A life of a starting liquid developer for electrostatic photography is prolonged by using a supplemental developer that returns an electrically charged state of the developer varied by repeated use of the developer to an original or appropriate state of the electrical charge for electrostatic photography.

28 Claims, No Drawings

LIQUID DEVELOPER FOR ELECTROSTATIC PHOTOGRAPHY

BACKGROUND OF THE INVENTION

1. Field of the Invention

The present invention relates to a supplemental liquid developer for electrostatic photography, more specifically to an improvement of the life of a liquid developer for electrostatic photography by such a supplemental liquid developer.

2. Description of the Related Art

The following liquid developers for electrostatic photography are typical of those proposed to date:

One obtained by kneading a colorant such as carbon black, or an organic pigment or dye, a binder such as acrylic resin, a synthetic rubber, rosin or a rosin derivative, and a charge control agent such as an aliphatic or aromatic carboxylic acid, in a three-roll mill, a ball mill, etc., to disperse them in a nonpolar insulating liquid or solvent (see Japanese Examined Patent Publication (Kokoku) No. 51-1301).

One obtained by copolymerizing a monomer having a polymerizing active double bond, which is soluble in a nonpolar insulating carrier liquid but becomes insoluble after polymerization, for example, a vinyl ester of acetic acid, propionic acid, etc., a monomer containing an aliphatic group having more than 7 carbon atoms, which is soluble in or compatible with the above carrier liquid during polymerization, for example, 2-ethyl hexylmethacrylate, lauryl methacrylate, stearyl methacrylate, etc., and a monomer having a polar group and a plymerizing active double bond for charge control, for example, acrylic acid, methacrylic acid, maleic acid, anhydrous maleic acid, acrylamido, etc., in a nonpolar insulting carrier liquid to disperse a copolymer particle therein, followed by coloring it with an organic dye or pigment, etc. (see Japanese Unexamined Patent Publication (Kokai) No. 60-249160).

One obtained by first copolymerizing a monomer containing a double bond and more than 7 carbon atoms soluble or compatible, during polymerization, for example, 2-ethylhexyl methacrylate, lauryl methacrylate, stearyl acrylate, etc. and a monomer capable of esterification, for example, acrylic acid, glycidyl methacrylate, etc., in a nonpolar insulating carrier liquid; esterifying the resultant copolymer at a portion corresponding to the monomer for esterification, for example, glycidyl methacrylate, acrylic acid, to provide a pendant group having a double bond to the copolymer; polymerizing a monomer such as vinyl acetate, vinyl propionate, etc., to the copolymer using the double bond to make the copolymer insoluble in the nonpolar insulating carrier liquid and disperse a polymer particle therein; adding a metallic soap such as cobalt naphthanate or manganese octenate as a charge control agent, if necessary; followed by coloring with carbon black or an organic dye or pigment (see Japanese Examined Patent Publication (Kokoku) No. 56-10619, corresponding to U.S. Ser. No. 810841 filed on May 26, 1969 and U.S. Ser. No. 7253 filed on Jan. 30, 1970, and Japanese Unexamined Patent Publication (Kokai) No. 53-54029).

Schematically, these liquid developers for electrostatic photography are formed by dispersing, as main components, a colorant, a binder and a charge control agent in a nonpolar insulating carrier liquid, but the distinguishing of a colorant, a binder and a charge control agent is not strict, and in practice, one chemical ingredient may play all or a part of the roles of two components such as the colorant and the charge control agent.

In the development process, electrophoresis occurs in a liquid developer in accordance with an electrical charge of an electrostatic latent image formed on a surface of a photosensitive material for electrophotography or an electrostatic recording material, a toner in the developer adheres thereto, and an image is developed (visualized). After repeated developments, although a new developer is promptly supplemented, the image becoms unclear, i.e., tailing, decrease of the amount of adhesion, adhesion to a non-image portion, etc. occur, and an agglomeration of particles in the developer occurs to increase the particle size and cause precipitation thereof. Accordingly, a developer has only a certain life.

SUMMARY OF THE INVENTION

The object of the present invention is to extend the life of a liquid developer for electrostatic photography.

To attain the above object, the inventors carried out an investigation and found that, upon repeated development, a composition of a liquid developer is not consumed uniformly and certain components are preferentially consumed, to vary the state of the composition from the starting composition; that the above mentioned problems arise due to a inappropriate strength of the electrically charged state of the developer caused by variations of the composition, and that, as a result of the above, by changing a composition of a supplemental liquid developer from a composition of a starting liquid developer and returning the strength of electrically charged state of a colorant and a binder in a supplemented developer to a desired state, clear images can be stably produced for an extended period of time. As a result, the present invention was created.

Therefore, according to the present invention, there is provided a process for supplementing a liquid developer in an electrostatic photography apparatus, comprising supplying a starting liquid developer to the electrostatic photography apparatus, the starting liquid developer containing a colorant, a binder and a charge control agent in a nonpolar insulating carrier liquid; consuming a portion of the starting liquid developer such that it becomes difficult to obtain an adequate electrostatic photography image when using the starting liquid developer; and supplementing a supplemental liquid developer to the electrostatic photography apparatus, in which an improvement is obtained in that the supplemental liquid developer has a composition of a colorant, a binder, and a charge control agent in a nonpolar insulating carrier liquid different from a composition of the starting liquid developer such that the supplemented liquid developer in the electrostatic photography apparatus holds a state of charge of the colorant and the binder within a predetermined state suitable for electrostatic photography.

According to the present invention, there is also provided a combination of starting and supplemental liquid developers for electrostatic photography, the starting and supplemental liquid developers containing a colorant, a binder and a charge control agent in a nonpolar insulating carrier liquid, in which the supplemental liquid developer has a composition different from that of the starting liquid developer is at least one of the ingredients and concentrations thereof such that a state of charge of the colorant and the binder of the starting liquid developer, varied by repeated use for electrostatic photography, the varied state of charge of the colorant and the binder being not suitable for electrostatic photography, is returned to a state of charge of the colorant and the binder suitable for electrostatic photography.

PREFERRED EMBODIMENTS OF THE INVENTION

The nonpolar insulating carrier liquid acts as a dispersion medium and includes hexane, octane, isooctane, decane, isoparaffin-series solvents such as Isopar E, Isopar G and Isopar H, sold from Exxon, and Shellsol 71, sold from Shell.

The colorant acts to visualize an image and may be formed of various inorganic and/or organic pigments and dyes, including carbon black, ultramarine, prussian blue, phthalocyanine based pigments, azine-based dyes, triphenylmethane-based dyes and pigments, azo-based dyes and pigments, etc.

The binder is a resin or polymer and is used for fixing an image, and includes polymers of vinyl ester such as vinyl acetate and vinyl propionate; polymers of an ester of acrylic acid and methacrylic acid; synthetic rubbers, such as stylene-butadiene rubber; natural rubbers; modified natural rubbers; rosin; modified rosins; epoxy resins; silicone resins; stylene resins; coumarone-indene resins; and petroleum-based resins, such as cyclopentadiene polymer.

The charge control agent is used to maintain the strength of the state of electrical charge of a colorant and a binder, and includes inorganic and organic pigments; organic dyes; aliphatic and aromatic carboxylic acids, alcohol ketone, esters, eters and amines, having a polar group in its molecule; and polymers including the above. Also, various metallic soaps such as cobalt naphtenate and manganese octenate may be used for the above purpose, if necessary.

As mentioned before, the above four components are not clearly separated or distinguished. For example, a certain dye or pigment may act as a colorant as well as a charge control. A resin or polymer having a polar group may act as a fixer or a binder as well as a charge control.

In the present invention, the state of an electrical charge of a liquid developer can be determined by the following criteria:

(1) State of adhesion of a developer

When a state of an electrical charge of a developer is adequate, the developer (toner) uniformly adheres to an image having an area of about 10 mm square. When a state of an electrical charge of a developer is inadequate, due to an excess or insufficient charge control, the developer (toner) does not adhere to a central portion of an image having an area of about 10 mm square and the amount of adhered developer (toner) is less than half of that adhered in an adequate state.

(2) Resolving power

When adequate, a developer has a resolving power of 10–12 lines/mm, but when inadequate, "tailing" of the letters or fine line patterns appears and the resolving power is reduced to 2–3 lines/mm.

(3) Particle size of a developer

When adequate, the particle size of a developer (toner) is about 0.2–0.5 μm and the particles are dispersed uniformly. When inadequate, the particle size is increased to 1–10 μm and the particles are precipitated.

According to the present invention, a state of an electrical charge of a liquid developer determined by the criteria as mentioned above, when worsened by repeated use of the developer, is returned to an original or adequate state by a supplemental liquid developer having a composition different from that of a starting liquid developer, the composition of the supplemental liquid developer being such that the worsened state of charge is returned to an original or adequate state. The difference of the composition between the starting and supplemental liquid developers may be any difference of all or part of ingredients or concentrations thereof, or a combination of these, as long as a state of an electrical charge of a developer varied by repeated use can be returned to an original state (within a predetermined tolerance). Control of the concentration or kind, or both thereof, of a charge control agent is very simple, and it is sufficient in most cases to adjust a state of charge of a developer. Usually, upon repeated use of a developer, a colorant and/or a binder are preferentially consumed and a content of a charge control agent in the developer is increased. Therefore, in such a case, it is sufficient or adequate to reduce a concentration of a charge control agent in a supplemental liquid developer in comparison to the starting liquid developer.

Note, a supplemental liquid developer used in the present invention is not suitable in most cases for use as a starting liquid developer.

The following tables include adequate amounts (based on parts by weight) of some charge control agents as starting and supplemental liquid developers, which have been found in the following Examples. In each Table, it is considered that the amounts of charge control agents also indicate the relative strength of the charge control agents.

TABLE 1

(obtained from Examples 1 to 3)

| Starting liquid developer | | Supplemented liquid developer | |
|---|---|---|---|
| gum rosin | 30–40 | gum rosin | 5–10 |
| gum rosin | 30–40 | disproportionated rosin | 10–20 |
| hydrogenated rosin | 20–30 | hydrogenated rosin | 5–10 |
| polymerized rosin | 30–40 | polymerized rosin | 10–15 |
| disproportionated rosin | 20–30 | disproportionated rosin | 5–10 |

TABLE 2

(obtained from Examples 4 to 6)

| Starting liquid developer | | Supplemented liquid developer | |
|---|---|---|---|
| acrylic acid | 1–5 | acrylic acid | 0.1–0.8 |
| crotonic acid | 1–3 | crotonic acid | 0.2–0.7 |
| maleic acid | 0.5–2.5 | maleic acid | O.1–0.4 |
| itaconic acid | 0.4–3 | itaconic acid | 0.05–0.3 |
| citraconic acid | 0.5–1.5 | citraconic acid | 0.1–0.4 |
| anhydrous maleic acid | 0.5–3 | anhydrous maleic acid | 0.1–0.4 |
| anhydrous itaconic acid | 0.3–3 | anhydrous itaconic acid | 0.05–0.2 |
| dimethyl maleate | 2–8 | dimethyl maleate | 0.4–1.2 |
| glycidil methacrylate | 0.7–5 | glycidil methacrylate | 0.1–0.5 |
| oxyethyl acrylate | 2–5.5 | oxyethyl acrylate | 0.6–1.5 |

TABLE 3

(obtained from Examples 7 to 9)

| Starting liquid developer | | Supplemented liquid developer | |
|---|---|---|---|
| zirconium naphtenate | 10–30 | zirconium naphtenate | 5–10 |
| aluminum stearate | 30–40 | aluminum stearate | 10–20 |

TABLE 3-continued (obtained from Examples 7 to 9)

| Starting liquid developer | | Supplemented liquid developer | |
|---|---|---|---|
| cobalt naphtenate | 10–20 | cobalt naphtenate | 2–5 |
| lead naphtenate | 20–30 | lead naphtenate | 10–15 |
| zirconium octenate | 10–20 | zirconium octenate | 1–5 |

In these Tables, the amounts of charge control agents are derived from the cases in which they are bound to a certain colorant, binder and solvent, and certain amounts thereof, in the following Examples. But, even if the kinds or amounts of colorant, binder and solvent are different from the above, the relative amounts or concentrations of a certain charge control agent in such starting and supplemental liquid developers, as well as the relative amounts or concentrations of different charge control agents, can be determined with reference to the Tables.

As seen from the Tables, when only the amount of a same charge control agent is changed between starting and supplemental liquid developers, the amount of the charge control agent in a supplemental liquid developer is typically less than 80%, half, one third or one fourth of that of the starting liquid developer.

The present inventors carried out further investigations and found that the life of a liquid developer can be extended by changing a product of "a strength of charge" and "a concentration" of a charge control agent such that the product is substantially smaller in a supplemental developer in comparison to a starting developer.

The following Table shows the strength of charge (state of electrical charge) of various charge control agents, which were obtained from the following Examples (10 and 11). The liquid developers used were the same except that the kind of charge control agent was changed, but the amounts of the charged control agents were the same. Each of the developers was supplied to an Electrophotographic Reproduction Apparatus AP-3WDX manufactured by Iwasaki Tsushinki K.K., and an image was formed on Master Paper for Electrophotography Reproduction EL-1, manufactured by Iwasaki Tsushinki K.K. The strength of charge was expressed by the state of adhesion of a developer (toner) at a portion of an image; the portion having an area of 10 mm square. The estimation was conducted visually on a 10 points basis. The complete black image (toner adhered entirely to the image area) was estimated as 10 points, and a substantially white image (substantially no toner adhered to the image area) was estimated as 1 point, the intermediate conditions being estimated as points 2 to 9. That is, the higher the estimated point, the higher the strength of charge of a charge control agent, and vice versa.

TABLE 4

| Charge control agent | Strength of charge imparted |
|---|---|
| acrylic acid | 5 |
| methacrylic acid | 4 |
| crotonic acid | 1 |
| maleic acid | 10 |
| phthalic acid | 3 |
| itaconic acid | 8 |
| citraconic acid | 7 |
| anhydrous acrylic acid | 4 |
| anhydrous methacrylic acid | 4 |
| dimethyl aminomethylmethacrylate | 6 |
| anhydrous maleic acid | 10 |
| anhydrous itaconic acid | 7 |

TABLE 4-continued

| Charge control agent | Strength of charge imparted |
|---|---|
| glycidil methacrylate | 5 |
| dimethyl maleate | 6 |
| diethyl maleate | 6 |
| dimethyl phthalate | 2 |
| ethyl crotonate | 1 |
| methyl crotonate | 1 |
| diethyl phthalate | 2 |
| dimethylamine laurate | 7 |

Referring to the above estimation of the charging strength, a ratio of a product of "a charging strength" and "a concentration" of a charge control agent, between starting and supplemental developers, is desirably at least 10:1 to 10:5, preferably 10:2 to 10:3.

EXAMPLE 1 (COMPARATIVE)

| | |
|---|---|
| isobutyl methacrylate-lauryl methacrylate copolymer (copolymerizing ratio 8:2) | 200 parts |
| toluene | 1100 parts |
| oil black BW (Orient Kagaku K. K.) | 100 parts |
| gum rosin (Arakawa Rinsan K. K.) | 30 parts |

The above components were used, and a copolymer was solved in a toluene in a stainless steel beaker, into which the oil black BW and the gum rosin were added and preliminarily dispersed, followed by kneading in a three roll mill. The kneaded dispersion was diluted with Isopar G (Exxon) to form a developer A having a 0.5% solid content. (This was in accord with the process described in Japanese Examined Patent Publication (Kokoku) No. 51-13021).

The developer A was supplied to an electrostatic electrophotographic reproduction apparatus AP-3WDX (manufactured by Iwasaki Tsushinki K.K.) as a starting developer, Master paper for electrostatic electrophotography EL-1 (manufactured by Iwasaki Tsushinki K.K.) was used for obtaining an image, and the reproduction process was repeated. Whenever the developer was consumed and became insufficient, the same developer A was added as a supplemental developer. Thus, the operation of reproduction was continued while supplementing a developer when necessary.

The reproduced image became unclear after about 1000 plates.

EXAMPLE 2

A developer B was prepared in accordance with the same procedures as described in Example 1 except that 10 parts of gum rosin were used. Namely, the amount of the gum rosin, the material acting as a charge control, was lower in Example 2 than in Example 1.

The developer A was used as a starting developer in the electrophotographic reproduction apparatus AP-3WDX. The reproduction process was repeated and the developer B was added whenever the developer became insufficient. A clear image was stably reproduced up to about 5000 plates.

EXAMPLE 3

A developer C was prepared in accordance with the same procedures as described in Example 1, except that 30 parts of disproportionated rosin (obtained from Arakawa Rinsan K.K.) were used instead of the 30 parts of gum rosin. Namely, the kind of charge control agent in the developer C was different from that in the developer A.

The developer A was used as a starting developer and the developer C was used as a supplemental developer. The rèproduction process was repeated in an electrophotographic reproduction apparatus AP-3WDX, as in Example 2, and a clear image ws stably reproduced up to about 4000 plates.

EXAMPLE 4 (COMPARATIVE)

| | |
|---|---|
| lauryl methacrylate monomer | 20 parts |
| vinyl acetate monomer | 80 parts |
| glcidyl methacrylate monomer | 2 parts |
| azobisisobutylonitrile | 1 part |
| Isopar E (Exxon) | 200 parts |

The above ingredients were introduced into a four neck flask provided with a stirrer, a condenser, a nitrogen introducing pipe, and a thermometer, and polymerization under a flow of nitrogen was effected at 80° C. for 3 hours and then at 100° C. for 10 hours. Then, 1 part of 1,1'-azobiscyclohexane-1-carbonitrile was added and polymerization was effected at 100° C. for 5 hours. A clouded polymer dispersion was obtained. The dispersion was cooled and 2 parts of carbon black No. 1000 (Mitsubishi Kasei K.K.) were added thereto and preliminarily dispersed, followed by dispersion in a sand grinder for 3 hours. The dispersion was removed from the sand grinder and diluted with Isopar G to obtain a developer D having a solid content of 1%. (This process was in accord with the process described in Japanese Unexamined Patent Publication (Kokai) No. 60-249160).

The developer D was supplied as a starting developer to an electrostatic electrophotographic reproduction apparatus PM-357 (manufactured by Iwasaki Tsushinki K.K.) and reproductions were made on a master paper for electrostatic electrophotographic reproduction MLR-2 (manufactured by Iwasaki Tsushinki K.K.). Whenever the developer was consumed and became insufficient, the developer D was added as a supplemental developer. The reproduced image became unclear after about 700 plates.

EXAMPLE 5

A developer E was prepared in accordance with the same procedures as described in Example 4, except that the amount of glycidyl methacrylate monomer was reduced to 0.1 part. Namely, the developer E contained a reduced amount of the glycidyl methacrylate monomer, a main material acting as a charge control, in comparison with the developer D.

The developers D and E were used as starting and supplemental developers, respectively, and reproduction was repeated using the reproduction apparatus PM-357 and the master paper MLR-2. A clear image was stably reproduced up to about 3000 plates.

EXAMPLE 6

A developer F was prepared in accordance with the procedures described in Example 4, except that 0.5 part of dimethyl maleate was used in place of 2 parts of glycidyl methacrylate monomer. The developer F was different from the developer D in a main material acting as a charge control.

The developers D and F were used as starting and supplemental developers with the reproduction apparatus PM-357 and the master paper MLR-2. The reproduction process was repeated and a clear image was stably reproduced up to about 4000 plates.

EXAMPLE 7 (COMPARATIVE)

| | |
|---|---|
| lauryl methacrylate monomer | 97 parts |
| glycidil methacrylate | 3 parts |
| benzoyl peroxide | 0.8 part |
| Isopar E | 200 parts |

The above ingredients were introduced into a four-necked flask and polymerization under a flow of nitrogen was conducted at 100° C. for 3 hours. After the content of the flask was cooled, the following ingredients were added thereto.

| | |
|---|---|
| lauryl dimethyl amine | 0.3 part |
| methacrylic acid | 3 parts |
| hydroquinone | 0.1 part |

The temperature was then raised to 100° C. and reaction was continued for 8 hours to obtain a skeleton polymer solution.

| | |
|---|---|
| skeleton polymer solution | 30 parts |
| vinyl acetate monomer | 50 parts |
| crotonic acid | 1 part |
| azobisisobutylonitrile | 1 part |
| Isopar E | 100 parts |

The above were introduced into a four-necked flask and reaction under a flow of nitrogen at 100° C. was continued for 5 hours, to obtain a clouded polymer dispersion. After cooling, the dispersion was removed and introduced into a stainless steel beaker, to which 8 parts of Victoria blue were added and kneaded in a sand grinder for 3 hours. Then, Isopar G was added for diluting to a solid content of 0.7%, to which zirconium naphtenate was added until the concentration of zirconium naphtenate was 20 ppm, and thus a developer G was obtained. (This process was in accord with the process described in Japanese Examined Patent Publication (Kokoku) No. 56-10619 and Unexamined Patent Publication (Kokai) No. 53-54029).

The developer G as starting and supplemental developers, the reproduction apparatus AP-3WDX, and the master paper EL-1 were used, and the reproduction process was repeated.

The image became unclear after about 800 plates.

EXAMPLE 8

A developer H was prepared by the same procedures as described in Example 7, except that the concentration of the zirconium naphtenate was reduced to 5 ppm.

The developers G and H were used as starting and supplemental developers, respectively, and the reproduction apparatus AP-3WDX and the master paper EL-1 were used and the reproduction process was repeated.

A clear image was stably reproduced up to about 4000 plates.

EXAMPLE 9

A developer I was prepared by the procedures described in Example 7, except that 10 ppm of aluminum stearate was added in place of the zirconium naphtenate.

The developers G and I were used as starting and supplemental developers, respectively, and the reproduction apparatus AP-3WDX and the master paper EL-1 were used and the reproduction process was repeated.

A clear image was stably reproduced up to about 3000 plates.

The results of the above Examples are summarized in Table 5. Table 5 shows that the developers according to the present inventions have a life 5 to 7 times longer than that of the conventional developers.

TABLE 5

| Starting developer | Supplemental developer | Life (No. of plates) |
|---|---|---|
| Developer A | Developer A | 1000 |
| Developer A | Developer B | 5000 |
| Developer A | Developer C | 4000 |
| Developer D | Developer D | 700 |
| Developer D | Developer E | 3000 |
| Developer D | Developer F | 4000 |
| Developer G | Developer G | 800 |
| Developer G | Developer H | 4000 |
| Developer G | Developer I | 3000 |

EXAMPLE 10 (COMPARATIVE)

| | |
|---|---|
| lauryl methacrylate monomer | 15 parts |
| vinyl acetate monomer | 60 parts |
| anhydrous maleic acid | 2 parts |
| azobisisobutylonitrile | 0.5 parts |
| Isopar E (Exxon) | 170 parts |

The above ingredients were introduced into a four-necked flask provided with a stirrer, a condenser, a nitrogen introducing pipe, and a thermometer, and polymerization was conducted under a nitrogen flow at 80° C. for 3 hours and then at 100° C. for 10 hours. Then, 1 part of 1,1'-azobiscyclohexane-1-carbonitrile was added and polymerization was conducted at 100° C. for 5 hours, to obtain a clouded polymer dispersion.

The dispersion was cooled, and then introduced into a stainless steel beaker, to which 2 parts of carbon black No. 1000 (Mitsubishi Kasei K.K.) were added and preliminarily dispersed, and then dispersion by a sand grinder for 3 hours. The dispersion was removed from the sand grinder and diluted by Isopar H to provide a solid content of 1%, and thus a developer J was obtained.

The developer J was used as the starting and supplemental developer, the reproduction apparatus AP-3WDX, and the master paper EL-1 were used, and the reproduction process was repeated.

The reproduced image became unclear after about 800 plates.

EXAMPLE 11

A developer K was prepared in the same procedures as described in Example 10, except that 4 parts of crotonic acid was used in place of 2 parts of anhydrous maleic acid. A product of the amount (concentration) and the strength of charge of the charge control agent of the developer J was $10\times2=20$ and that of the developer K was $1\times4=4$. Therefore, the product of the developer K was smaller than the product of the developer J.

The developers J and K were used as starting and supplemental developers, respectively, and reproduction apparatus AP-3WDX and the master paper EL-1 were used and the reproduction process was repeated.

A clear image was stably obtained up to about 8000 plates.

EXAMPLE 12

The procedures of Example 11 were repeated, and the charge control agents listed in Table 6 were used in place of the anhydrous maleic acid in Example 10, in the developers.

The added amounts of the charge control agents and the life of each developer are shown in Table 6.

TABLE 6

| | | Starting developer | | | Supplemental developer | | | |
|---|---|---|---|---|---|---|---|---|
| | | Charge control agent | Amount (parts) | Strength of charge | Charge control agent | Amount (parts) | Strength of charge | Life (plate) |
| Comparative examples | 1 | anhydrous maleic acid | 2 | 20 | *same as left | | | 800 |
| | 2 | itaconic acid | 3 | 24 | anhydrous maleic acid | 2.5 | 25 | 500 |
| | 3 | glycidil methacrylate | 4 | 20 | crotonic acid | 20 | 20 | 600 |
| | 4 | acrylic acid | 3 | 15 | same as left | | | 900 |
| Working examples | 1 | anhydrous maleic acid | 2 | 20 | crotonic acid | 4 | 4 | 8000 |
| | 2 | glycidil methacrylate | 3 | 15 | acrylic acid | 0.5 | 2.5 | 7000 |
| | 3 | itaconic acid | 2 | 16 | phthalic acid | 1 | 3 | 9000 |
| | 4 | anhydrous itaconic acid | 3 | 21 | dimethyl phthalate | 3 | 6 | 6000 |
| | 5 | citraconic acid | 3 | 21 | crotonic acid | 3.5 | 3.5 | 7000 |
| | 6 | dimethyl maleate | 4 | 24 | anhydrous maleic acid | 0.4 | 4 | 9000 |
| | 7 | acrylic acid | 4 | 20 | itaconic acid | 0.3 | 2.4 | 6000 |
| | 8 | dimethyl maleate | 3 | 18 | citraconic acid | 0.5 | 3.5 | 7000 |
| | 9 | metacrylic acid | 5 | 20 | maleic acid | 0.4 | 2.5 | 7000 |
| | 10 | dimethylaminoethylene methacrylate | 3 | 18 | itaconic acid | 0.2 | 1.6 | 6000 |

*Working examples were in accordance with the present invention.

We claim:

1. A process for supplementing a liquid developer in an electrostatic photography apparatus, comprising supplying a starting liquid developer to an electrostatic photography apparatus, the starting liquid developer containing a colorant, a binder and a charge control agent in a nonpolar insulating carrier liquid; consuming a portion of the starting liquid developer such that it becomes difficult to obtain an adequate electrostatic photography image when using the starting liquid developer; and then supplementing a supplemental liquid developer in the electrostatic photography aparatus, characterized by the improvement in that the supplemental liquid developer has a composition of a colorant, a binder and a charge control agent in a nonpolar insulating carrier liquid, different from a composition of the starting liquid developer such that the supplemented liquid developer in the electrostatic photography apparatus maintains a state of charge of the colorant and the binder within a predetermined state suitable for electrostatic photography.

2. A process according to claim 1, wherein at least one of the colorant, the binder and the charge control agent of the supplemental liquid developer are different from those of the starting liquid developer.

3. A process according to claim 1, wherein an amount ratio of the colorant, the binder and the charge control agent of the supplemental liquid developer is different from that of the starting liquid developer.

4. A process according to claim 1, wherein an amount ratio of the charge control agent to the colorant and the binder of the supplemental liquid developer is substantially smaller than that of the starting liquid developer.

5. A process according to claim 4, wherein the ratio of the charge control agent to the colorant and the binder of the supplemental liquid developer is less than 80% of that of the starting liquid developer.

6. A process according to claim 5, wherein the ratio of the charge control agent to the colorant and the binder of the supplemental liquid developer is less than half of that of the starting liquid developer.

7. A process according to claim 6, wherein the ratio of the charge control agent to the colorant and the binder of the supplemental liquid developer is less than one third of that of the starting liquid developer.

8. A process according to claim 7, wherein the ratio of the charge control agent to the colorant and the binder of the supplemental liquid developer is less than one fourth of that of the starting liquid developer.

9. A process according to claim 4, wherein the charge control agents and amounts thereof of the starting and supplemental liquid developers are selected from the following combinations (amounts being based on parts by weight):

| Starting liquid developer | | Supplemented liquid developer | |
|---|---|---|---|
| (1) gum rosin | 30–40 parts | gum rosin | 5–10 |
| (2) gum rosin | 30–40 | disproportionated rosin | 10–20 |
| (3) hydrogenated rosin | 20–30 | hydrogenated rosin | 5–10 |
| (4) polymerized rosin | 30–40 | polymerized rosin | 10–15 |
| (5) disproportionated rosin | 20–30 | disproportionated rosin | 5–10 |
| (6) acrylic acid | 1–5 | acrylic acid | 0.1–0.8 |
| (7) crotonic acid | 1–3 | crotonic acid | 0.2.–0.7 |
| (8) maleic acid | 0.5–2.5 | maleic acid | 0.1–0.4 |
| (9) itaconic acid | 0.4–3 | itaconic acid | 0.05–0.3 |
| (10) citraconic acid | 0.5–1.5 | citraconic acid | 0.1–0.4 |
| (11) anhydrous maleic acid | 0.5–3 | anhydrous maleic acid | 0.1–0.4 |
| (12) anhydrous itaconic acid | 0.3–3 | anhydrous itaconic acid | 0.05–0.2 |
| (13) dimethyl maleate | 2–8 | dimethyl maleate | 0.4–1.2 |
| (14) glycidil methacrylate | 0.7–5 | glycidil methacrylate | 0.1–0.5 |
| (15) oxyethyl acrylate | 2–5.5 | oxyethyl acrylate | 0.6–1.5 |
| (16) zirconium naphtenate | 10–30 | zirconium naphtenate | 5–10 |

-continued

| Starting liquid developer | | Supplemented liquid developer | |
|---|---|---|---|
| (17) aluminum stearate | 30–40 | aluminum stearate | 10–20 |
| (18) cobalt naphtenate | 10–20 | cobalt naphtenate | 2–5 |
| (19) lead naphtenate | 20–30 | lead naphtenate | 10–15 |
| (20) zirconium octenate | 10–20 | zirconium octenate | 1–5 |

10. A process for supplementing a liquid developer in an electrostatic photography apparatus, comprising supplying a starting liquid developer to an electrostatic photography apparatus, the starting liquid developer containing a colorant, a binder and a charge control agent in a nonpolar insulating carrying liquid; consuming a portion of the starting liquid developer and changing the state of charge of the colorant and binder in the liquid developer; and supplementing a supplemental liquid developer in the electrostatic photography apparatus, characterized by the improvement in that the supplemental liquid developer contains a colorant, a binder and a charge control agent in a nonpolar insulating carrier liquid, a product of a multiplication of a strength of imparting a charge by a concentration of the charge control agent in the supplemental liquid developer being substantially smaller than that of the starting liquid developer such that the supplemented liquid developer in the electrostatic photography apparatus maintains a state of a charge of the colorant and the binder within a predetermined state suitable for electrostatic photography, wherein the charge control agents of the starting and supplemental liquid developers are selected from the following chemicals and the strengths of imparting a charge of the charge control agent are taken from the following:

| Charge Control Agent | Strength of Charge Imparting |
|---|---|
| acrylic acid | 5 |
| methacrylic acid | 4 |
| crotonic acid | 1 |
| maleic acid | 10 |
| phthalic acid | 3 |
| itaconic acid | 8 |
| citraconic acid | 7 |
| anhydrous acrylic acid | 4 |
| anhydrous methacrylic acid | 4 |
| dimethyl aminomethylmethacrylate | 6 |
| anhydrous maleic acid | 10 |
| anhydrous itaconic acid | 7 |
| glycidil methacrylate | 5 |
| dimethyl maleate | 6 |
| diethyl maleate | 6 |
| dimethyl phthalate | 2 |
| ethyl crotonate | 1 |
| diethyl phthalate | 2 |
| dimethylamine laurate | 7 |

11. A process according to claim 10, wherein the product of the supplemental liquid developer is less than 80% of that of the starting liquid developer.

12. A process according to claim 11, wherein the product of the supplemental liquid developer, is less than half of that of the starting liquid developer.

13. A process according to claim 3, wherein the product of the supplemental liquid developer is less than one third of the starting liquid developer.

14. A process according to claim 14, wherein the product of the supplemental liquid developer is less than one fourth of the starting liquid developer.

15. A kit comprising individual starting and supplemental liquid developers for electrostatic photography, the starting and supplemental liquid developers containing a colorant, a binder and a charge control agent in a nonpolar insulating carrier liquid, in which the supplemental liquid developer has a composition different from that of the starting liquid developer in at least one of the ingredients and concentrations thereof such that a state of charge of the colorant and the binder of the starting liquid developer varied by repeated use for electrostatic photography, the varied state of charge of the colorant and the binder being not suitable for electrostatic photography, is returned to a state of a charge of the colorant and the binder suitable for electrostatic photography by combination with the supplemental liquid developer.

16. A combination according to claim 15, wherein at least one of the colorant, the binder and the charge control agent of the supplemental liquid developer are different from those of the starting liquid developer.

17. A combination according to claim 15, wherein ratio of the colorant, the binder and the charge control agent of the supplemental liquid developer is different from that of the starting liquid developer.

18. A combination according to claim 15, wherein a ratio of the charge control agent to the colorant and the binder of the supplemental liquid developer is substantially smaller than that of the starting liquid developer.

19. A combination according to claim 18, wherein the ratio of the charge control agent to the colorant and the binder of the supplemental liquid developer is less than 80% of that of the starting liquid developer.

20. A combination according to claim 19, wherein the ratio of the charge control agent to the colorant and the binder of the supplemental liquid developer is less than half of that of the starting liquid developer.

21. A combination according to claim 20, wherein the ratio of the charge control agent to the colorant and the binder of the supplemental liquid developer is less than one third of that of the starting liquid developer.

22. A combination according to claim 21, wherein the ratio of the charge control agent to the colorant and the binder of the supplemental liquid developer is less than one fourth of that of the starting liquid developer.

23. A combination according to claim 18, wherein the charge control agents and amounts thereof of the starting and supplemental liquid developers are selected from the following combinations (the amount being based on parts by weight):

| Starting liquid developer | | Supplemented liquid developer | |
|---|---|---|---|
| (1) gum rosin | 30–40 | gum rosin | 5–10 |
| (2) gum rosin | 30–40 | disproportionated rosin | 10–20 |
| (3) hydrogenated rosin | 20–30 | hydrogenated rosin | 5–10 |
| (4) polymerized rosin | 30–40 | polymerized rosin | 10–15 |
| (5) disproportionated rosin | 20–30 | disproportionated rosin | 5–10 |
| (6) acrylic acid | 1–5 | acrylic acid | 0.1–0.8 |
| (7) crotonic acid | 1–3 | crotonic acid | 0.2–0.7 |
| (8) maleic acid | 0.5–2.5 | maleic acid | 0.1–0.4 |

-continued

| Starting liquid developer | | Supplemented liquid developer | |
|---|---|---|---|
| (9) itaconic acid | 0.4–3 | itaconic acid | 0.05–0.3 |
| (10) citraconic acid | 0.5–1.5 | citraconic acid | 0.1–0.4 |
| (11) anhydrous maleic acid | 0.5–3 | anhydrous maleic acid | 0.1–0.4 |
| (12) anhydrous itaconic acid | 0.3–3 | anhydrous itaconic acid | 0.05–0.2 |
| (13) dimethyl maleate | 2–8 | dimethyl maleate | 0.4–1.2 |
| (14) glycidil methacrylate | 0.7–5 | glycidil methacrylate | 0.1–0.5 |
| (15) oxyethyl acrylate | 2–5.5 | oxyethyl acrylate | 0.6–1.5 |
| (16) zirconium naphtenate | 10–30 | zirconium naphtenate | 5–10 |
| (17) aluminum stearate | 30–40 | aluminum stearate | 10–20 |
| (18) cobalt naphtenate | 10–20 | cobalt naphtenate | 2–5 |
| (19) lead naphtenate | 20–30 | lead naphtenate | 10–15 |
| (20) zirconium octenate | 10–20 | zirconium octenate | 1–5 |

24. A kit comprising individual starting and supplemental liquid developers for electrostatic photography, the starting and supplemental liquid developers containing a colorant, a binder and a charge control agent in a nonpolar insulating carrier liquid, in which a product of a multiplication of a strength of imparting a charge to the colorant and binder by a concentration of the charge control agent in the supplemental liquid developer is substantially smaller than that of the starting liquid developer, and wherein the charge control agents of the starting and supplemental liquid developer are selected from the following chemicals and the strengths of imparting a charge of the charge control agents are taken from the following:

| Charge Control Agent | Strength of Charge Imparting |
|---|---|
| acrylic acid | 5 |
| methacrylic acid | 4 |
| crotonic acid | 1 |
| maleic acid | 10 |
| phthalic acid | 3 |
| itaconic acid | 8 |
| citraconic acid | 7 |
| anhydrous acrylic aid | 4 |
| anhydrous methacrylic acid | 4 |
| dimethyl aminomethylmethacrylate | 6 |
| anhdrous maleic acid | 10 |
| anhydrous itaconic acid | 7 |
| glycidil methacrylate | 5 |
| dimethyl maleate | 6 |
| diethyl maleate | 6 |
| dimethyl phthalate | 2 |
| ethyl crotonate | 1 |
| dimethl crotonate | 2 |
| diethyl phthalate | 2 |
| dimethylamine laurate | 7 |

25. A combination according to claim 24, wherein the product of the supplemental liquid developer in less than 80% of that of the starting liquid developer.

26. A combination according to claim 25, wherein the product of the supplemental liquid developer is less than half of that of the starting liquid developer.

27. A combination according to claim 26, wherein the product of the supplemental liquid developer is less than one third of the starting liquid developer.

28. A combination according to claim 27, wherein the product of the supplemental liquid developer is less than one fourth of the starting liquid developer.

* * * * *